US009903331B2

(12) United States Patent
Walder et al.

(10) Patent No.: US 9,903,331 B2
(45) Date of Patent: Feb. 27, 2018

(54) METHOD FOR THE INJECTOR-SPECIFIC DIAGNOSIS OF A FUEL INJECTION DEVICE AND INTERNAL COMBUSTION ENGINE HAVING A FUEL INJECTION DEVICE

(71) Applicant: MTU Friedrichshafen GmbH, Friedrichshafen (DE)

(72) Inventors: Michael Walder, Ravensburg (DE); Andreas Mehr, Kressbronn (DE); Frank Mlicki, Radolfzell (DE); Alexander Bernhard, Meckenbeuren (DE); Christian Wolf, Langenargen (DE)

(73) Assignee: MTU FRIEDRICHSHAFEN GMBH, Friedrichshafen (DE)

( * ) Notice: Subject to any disclaimer, the term of this patent is extended or adjusted under 35 U.S.C. 154(b) by 268 days.

(21) Appl. No.: 14/912,205

(22) PCT Filed: Aug. 1, 2014

(86) PCT No.: PCT/EP2014/002126
§ 371 (c)(1),
(2) Date: Feb. 16, 2016

(87) PCT Pub. No.: WO2015/022058
PCT Pub. Date: Feb. 19, 2015

(65) Prior Publication Data

US 2016/0186709 A1 Jun. 30, 2016

(30) Foreign Application Priority Data

Aug. 15, 2013 (DE) ..... 10 2013 216 255

(51) Int. Cl.
*F02M 65/00* (2006.01)
*F02D 41/22* (2006.01)
*F02D 41/38* (2006.01)

(52) U.S. Cl.
CPC ..... *F02M 65/001* (2013.01); *F02D 41/221* (2013.01); *F02D 41/3809* (2013.01);
(Continued)

(58) Field of Classification Search
CPC ..... F02M 2200/247; F02M 57/005; F02M 2200/40; F02M 65/00; F02M 65/001;
(Continued)

(56) References Cited

U.S. PATENT DOCUMENTS 7,121,265 B2 10/2006 Joos et al.
7,137,294 B2 11/2006 Eser et al.
(Continued)

FOREIGN PATENT DOCUMENTS

DE 10344181 A1 4/2005
DE 102004006896 A1 9/2005
(Continued)

*Primary Examiner* — Freddie Kirkland, III
(74) *Attorney, Agent, or Firm* — Lucas & Mercanti, LLP; Klaus P. Stoffel

(57) ABSTRACT

A method for the injector-specific diagnosis of a fuel injection device of an internal combustion engine, including the following steps: detecting a pressure progression in an individual accumulator of an injector in a time-resolved manner; evaluating the detected pressure progression; determining if there is a fault state of the injection device in the region of the injector on the basis of the detected and evaluated pressure progression; and identifying the fault state on the basis of the detected and evaluated pressure progression.

12 Claims, 3 Drawing Sheets

(52) U.S. Cl.
CPC ..... *F02M 65/00* (2013.01); *F02M 65/003* (2013.01); *F02D 2041/224* (2013.01); *F02D 2200/0602* (2013.01); *F02D 2200/0618* (2013.01)

(58) Field of Classification Search
CPC ..... F02M 65/003; F02D 2200/0602; F02D 41/3809; F02D 2041/224; F02D 41/221; F02D 2200/0618
See application file for complete search history.

(56) References Cited

U.S. PATENT DOCUMENTS

| | | | | |
|---|---|---|---|---|
| 7,272,486 | B2 | 9/2007 | Speetzen et al. | |
| 7,305,972 | B2 | 12/2007 | Kloos et al. | |
| 7,523,743 | B1 * | 4/2009 | Geveci | F02D 41/3863 123/456 |
| 7,769,530 | B2 * | 8/2010 | Hehle | F02D 41/3836 123/446 |
| 7,933,712 | B2 | 4/2011 | Ishizuka et al. | |
| 8,155,859 | B2 * | 4/2012 | Nakata | F02D 41/2474 701/103 |
| 8,214,131 | B2 * | 7/2012 | Kloos | F02D 41/3836 123/434 |
| 8,527,181 | B2 | 9/2013 | Walder et al. | |
| 2008/0027624 | A1 * | 1/2008 | Kloos | F02D 41/3836 701/103 |
| 2010/0280743 | A1 | 11/2010 | Hehle et al. | |
| 2012/0209544 | A1 | 8/2012 | Takashima | |
| 2014/0209065 | A1 | 7/2014 | Boog et al. | |
| 2016/0153382 | A1 * | 6/2016 | Walder | F02D 41/3809 701/103 |
| 2016/0298570 | A1 * | 10/2016 | Golz | F02D 41/3809 |

FOREIGN PATENT DOCUMENTS

| | | | |
|---|---|---|---|
| DE | 102006007365 | B3 | 5/2007 |
| DE | 102009002793 | A1 | 11/2010 |
| DE | 102009056381 | A1 | 6/2011 |
| DE | 102011080990 | B3 | 1/2013 |
| DE | 112010004995 | T5 | 1/2013 |
| EP | 2045458 | A2 | 4/2009 |
| GB | 2287101 | A | 9/1995 |
| WO | 03027472 | A1 | 4/2003 |
| WO | 2004057172 | A1 | 7/2004 |
| WO | 2013104986 | A1 | 7/2013 |

* cited by examiner

METHOD FOR THE INJECTOR-SPECIFIC DIAGNOSIS OF A FUEL INJECTION DEVICE AND INTERNAL COMBUSTION ENGINE HAVING A FUEL INJECTION DEVICE

The present application is a 371 of International application PCT/EP2014/002126, filed Aug. 1, 2014, which claims priority of DE 10 2013 216 255.3, filed Aug. 15, 2013, the priority of these applications is hereby claimed and these applications are incorporated herein by reference.

BACKGROUND OF THE INVENTION

The invention relates to a method for the injector-specific diagnosis of a fuel injection device of an internal combustion engine and to an internal combustion engine.

German laid-open patent application DE 10 2009 002 793 A1 discloses a method for performing open- and/or closed-loop control of an internal combustion engine with a common-rail fuel injection system, within the scope of which a pressure in an individual accumulator of an injector is recorded. This pressure is made available for the open-loop control of the internal combustion engine. In this context, there is provision, in particular, that the sequence of a main injection is open-loop and/or closed-loop controlled by means of the individual accumulator pressure measurement. The sequence of a pre-injection and/or of a post-injection can correspondingly also be open-loop and/or closed-loop controlled. In contrast, until now there has not been any known possible simple and reliable way of implementing an injector-specific diagnosis in terms of what is referred to as on-board diagnosis for the individual injectors of an internal combustion engine.

SUMMARY OF THE INVENTION

The invention is based on the object of providing a method which permits an injector-specific diagnosis of a fuel injection device of an internal combustion engine in a simple and reliable way.

The object is achieved in a method in which a pressure profile is recorded in an individual accumulator of an injector in a time-resolved fashion. The recorded pressure profile is evaluated. On the basis of the recorded and evaluated pressure profile it is determined whether there is a fault state of the injection device in the region of the injector. The fault state is identified on the basis of the recorded and evaluated pressure profile. By means of the method it is, in particular, also readily possible to detect fault states up to defects of the individual injectors on an injector-specific basis during operation of the internal combustion engine, and identify them and assign them to the individual injectors. Conclusions can be drawn about the injector behavior by means of the individual accumulator pressure analysis. Faulty behavior of the injection system is therefore detected safely and reliably, wherein individual injectors or devices assigned to them can be identified as fault sources. It is then possible to eliminate the faults by means of defined measures. In this context it is not necessary initially to subject each individual injector to a costly examination, but rather a fault state which occurs can be identified by means of on-board diagnosis and can be assigned to the faulty part. This also avoids, in particular, time-consuming and expensive troubleshooting via customer service. The pressure profile in the individual accumulator is preferably measured in a time-resolved fashion by a pressure sensor which is arranged in the region of the individual accumulator, in particular by means of a strain gauge sensor. The pressure signal which is measured directly at the respective injector can be assigned unambiguously to the injector, in particular since no interference frequencies of other injectors or of other cylinders of the internal combustion engine are present on the pressure signal of the individual accumulator or are present only to a negligible degree. Therefore, filtering and/or calibration of the recorded pressure profile become superfluous, at any rate for injector-specific separation of the signal. Nevertheless, it is possible to carry out such filtering and/or calibration.

However, within the scope of the evaluation of the recorded pressure profile, filtering is preferably carried out in order to be able to work with a smoothed signal. This facilitates, in particular, the determination of injection times, to be explained below, from the pressure signal.

Within the scope of the determination as to whether there is a fault state, it is ascertained, on the basis of predetermined criteria, whether the individual injector under consideration is operating free of faults or whether disruption is occurring. If a fault state is determined it is readily possible to identify it, with the result that it is also determined what fault is present. The assignment of the fault to the individual injector is readily possible by means of the assignment of the measured pressure signal to the corresponding individual accumulator.

A method is preferred which is defined by the fact that the pressure profile is recorded in a time-resolved fashion in the individual accumulator synchronized with an energization of the injector. In this context, the pressure profile is preferably recorded simultaneously or overlapping with the energization of the injector. The synchronization of the recording of the pressure with the injector energization ensures that the recorded pressure profile can be unambiguously assigned to an injection event, for example a pre-injection, a main injection or a post-injection. In addition, the synchronization ensures that the pressure profile is recorded when an injection event is actually to take place, with the result that it is, in particular, not necessary to record the pressure profile continuously. As a result, the quantity of data which is to be recorded can be reduced, and the method can be simplified.

Alternatively or additionally there is provision that the recorded pressure profile is assigned to an injection event, for example a pre-injection, a main injection or a post-injection. A corresponding assignment is possible, for example, if a control unit which controls both the energization of the injectors and the recording of the pressure profiles generates a time signal, wherein time values are assigned by the control unit both to the recorded pressure profiles and also to the injection events. On the basis of these time values, it is then readily possible to assign recorded pressure profiles to individual injection events. In this context, certain criteria are preferably taken into account in order to ensure a fault-free assignment. For example, a start of injection which is obtained from the recorded pressure profile must occur chronologically after a start of an energization which is predefined by the control unit. An end of injection, which is obtained from the pressure profile, must occur chronologically after the end of an energization which is predefined by the control unit. A further additional parameter can be that the time interval between the start of injection obtained from the pressure profile and a setpoint start of injection which is stored in the control unit must not be greater than a predeterminable maximum, which can consequently be parameterized. A further possible criterion is that the time interval between the end of injection which is recorded on the basis of the pressure profile and a setpoint end of injection which is stored in the control unit must not be greater than a predeterminable maximum.

Overall, it is therefore possible, by means of the method, to use a diagnosis of the fuel injection device for any injection event, in particular for a pre-injection, a main injection or a post-injection. In this context, precise assignment of the recorded pressure profiles to the individual injection events is always possible.

A method is also preferred which is defined by the fact that it is checked whether the injector is energized. It is possible that although the control unit brings about energization of the injector, a voltage or a current does not arrive at said injector. For example, cables may be damaged or disconnected. It is also possible for the control unit itself to have a defect, as a result of which said control unit does not correctly actuate the injector, and consequently does not correctly bring about the energization of the injector. At least one energization value of the energization of the injector is preferably recorded and is used to determine a fault state and/or to identify the fault state. For example, a voltage or a current can be recorded as the energization value, wherein in the case of correct energization of the injector these values change in a characteristic way, and the energization of the injector can therefore be determined.

In this context, in one embodiment of the method correct energization of the injector is determined if the recorded energization value exceeds or undershoots a predetermined threshold value. In this context, the exceeding or undershooting of the predetermined threshold value depends, in particular, on which sign the energization value has, or which sign the change in the energization value has when the injector is energized. It is also possible for the absolute value of the energization value to be compared with a threshold value at the time of the energization of the injector, wherein preferably correct energization is determined if the absolute value of the energization value exceeds a predetermined threshold value. In another embodiment of the method it is also possible that it is checked whether the recorded energization value is in a predetermined interval. In this context, correct energization is determined if the recorded energization value is in the predetermined interval, while incorrect energization or a failure of energization is determined if the energization value is outside the interval.

A method is also preferred which is defined by the fact that a fault state is determined and is identified as an absence of injection if the injector is energized, wherein a pressure drop in the pressure profile is not determined. The evaluation of the recorded pressure profile therefore includes in this case that it is checked whether a pressure drop can be determined. If, in fact, a correct injection occurs if the injector is energized, the pressure in the individual accumulator drops during the injection. If such a pressure drop does not occur when the injector is energized correctly, it is assumed within the scope of the method that despite correct energization of the injector an injection has not taken place. This can arise, for example, owing to the fact that an injector needle which serves as a valve element is sticking and therefore it does not become detached from its seat when the injector is energized.

A fault state is preferably identified as an absence of injection only if in addition a setpoint volume of fuel which is to be injected and which is predefined by the control unit in an operating-point-dependent fashion is greater than a predetermined minimum value. This procedure is based on the idea that below a specific setpoint volume which is to be injected it is not possible to carry out reliable detection of the pressure drop by evaluating the pressure profile in the individual accumulator. In this case, when the predetermined minimum value is undershot it is therefore not possible to determine definitively whether the injection has actually failed to occur or whether the injection which is actually carried out has merely not been detected correctly. Therefore, within the scope of the identification of the fault state it is preferably always checked whether the setpoint volume which is predefined for the injection by the control unit exceeds the predetermined minimum value. If this is the case, and if, in addition, a pressure drop is not determined in the pressure profile, it can be reliably assumed that a fault state which can be identified as an absence of injection is present.

Alternatively or additionally, a fault state is determined and is identified as an incorrect injection if the injector is not energized, wherein a pressure drop in the pressure profile is determined. Here, the inverse case with respect to the previously discussed case is accordingly present, wherein the injector is in fact not correctly energized even though a pressure drop is determined in the pressure profile, and consequently an injection of fuel into the cylinder takes place. Such an incorrect injection without energization of the injector can occur, for example, if a pilot valve which controls the injector opening becomes stuck or if there is a short circuit to ground in the actuation means of the injector.

Alternatively or additionally, a fault state is determined and is identified as a quantity-limiting valve fault of a quantity-limiting valve which is assigned to the injector, if a characteristic excessive increase is determined in the pressure profile. The evaluation of the pressure profile accordingly also preferably includes the fact that the curve profile—preferably the filtered pressure profile—is examined for characteristic features such as, for example, the characteristic excessive increase, which is also referred to as the opening wave. If such an opening wave is detected, it is concluded within the scope of the method that the quantity-limiting valve which is assigned to the injector and is intended to prevent excessive metering of fuel into the cylinder of the internal combustion engine which is assigned to the injector has a fault state.

Alternatively or additionally, a fault state is determined and is identified as continuous injection if an enduring pressure drop is detected. The pressure profile has here an initially continuously falling and later constantly low profile, because the injector is permanently open to the cylinder, with the result that a high pressure can no longer build up in the individual accumulator. Such a continuous injection indicates a dual fault, specifically, on the one hand, a defective quantity-limiting valve which does not prevent continuous outflow of fuel from the individual accumulator, and, on the other hand, a faulty injector which is continuously arranged in an open state and no longer closes.

Alternatively or additionally, a fault state is determined and is identified as invalid injection if an injection time which is obtained from the recorded pressure profile is outside a predetermined validity range. In this context, in one embodiment of the method, a start of injection is obtained as an injection time from the recorded pressure profile within the scope of the evaluation. Alternatively or additionally, in one embodiment of the method, an end of injection is obtained as injection time from the pressure profile within the scope of the evaluation. Within the scope of the method it is possible to define validity ranges for the start of injection and/or for the end of injection, and the injection times must be respectively present in said validity ranges.

For example, German laid-open patent application DE 10 2009 056 381 A1 discloses how a start of injection and an end of injection can be obtained from a recorded individual accumulator pressure within the scope of an evaluation.

At least one injection time characteristic diagram for at least one setpoint injection time is preferably stored in the control unit, in which characteristic diagram values for the setpoint injection time are stored as a function of a rail pressure of the injection system which is recorded by means of a rail pressure sensor.

Validity characteristic diagrams in which validity ranges for the injection times are stored, preferably in a rail-pressure-dependent fashion, that is to say as a function of a pressure in a high-pressure accumulator of the fuel injection device, are then preferably used within the scope of the method, said validity ranges defining, preferably symmetrical, intervals about the setpoint injection times. This is explained below, without restriction of the general applicability, for the start of injection as a selected injection time, but applies equally well also to the end of injection or to another injection time:

In a first validity characteristic diagram, a comparatively wide validity range is preferably stored. This validity range is also referred to as an unlearnt validity range and is applied, in particular, when a new injector is used in the internal combustion engine. A method for correcting the start of injection, which enters correction values for a start of an energization of the injector into a learning characteristic diagram, is implemented in the control unit. In the course of operation, the control unit records characteristic deviations of the injector and learns to actuate the injector by means of the entries in the learning characteristic diagram, in such a way that the actual start of injection is moved ever closer to the setpoint start of injection. In this context, within the scope of the method proposed here, learning progress is preferably recorded, and an instantaneously applicable validity range for the start of injection is defined more tightly about the setpoint start of injection as the learning progress increases. A fault state is always detected here when the start of injection which is obtained from the recorded pressure profile lies outside the instantaneously applicable validity range. Overall, in this context a larger fluctuation width for the start of injection is accepted in the case of a new injector than in the case of an injector which is operated over a relatively long time and for which the control unit has already learnt suitable actuation.

It is, however, possible that even in the case of an injector which is not defective per se short-term fluctuations occur which will not immediately lead to the determination of a defect. It is therefore preferably provided within the scope of the method that the instantaneously applicable validity range can be increased in turn if short-term drifting of the injector occurs.

The instantaneously applicable validity range is preferably varied as a function of the learning progress between the unlearnt validity range stored in the first validity characteristic diagram and a tighter learnt validity range stored in a second validity characteristic diagram. In this context, the learning progress is measured by means of a learning progress counter which is incremented if the start of injection lies within the learnt validity range. A maximum for the learning progress counter is preferably provided, the counter not being incremented further when said maximum is reached, wherein the instantaneously applicable validity range coincides with the learnt validity range if the learning progress counter is at its maximum value. In contrast, the instantaneously applicable validity range coincides with the unlearnt validity range if the learning progress counter is at the value zero. Between these limits, the instantaneously applicable validity range "breathes" as a function of the instantaneous value of the learning progress counter. The learning progress counter is preferably decremented by a predeterminable, and consequently parameterizable, value after the expiry of a predetermined time, for example an operating hour. The value of the learning progress counter is preferably stored in a learning characteristic diagram which stores values for the learning progress counter as a function of a fuel quantity to be injected and the rail pressure.

In order to intercept short-term drifting a first validity counter is preferably used to detect whether, although the start of injection lies within the unlearnt validity range, it is outside the learnt validity range. In this case, the first validity counter is incremented. If the start of injection is, in contrast, also inside the learnt range, the first validity counter is decremented again. A predeterminable maximum is provided, wherein the learning progress counter is decremented, with the result that the instantaneously applicable validity range is increased if this maximum is exceeded by the first validity counter.

It is emphasized that the validity ranges and counters presented here are provided on an injector-specific basis. Each injector is therefore assigned separate validity ranges and separate validity counters as well as learning progress counters, with the result that injector-specific detection is possible. Furthermore, in particular the validity ranges for the injection times are defined in a rail-pressure-dependent fashion, wherein they are stored in validity characteristic diagrams as a function of the rail pressure.

Alternatively or additionally, a fault state is determined and is identified as a level fault, if the recorded pressure profile undershoots or exceeds predetermined level limits. The pressure profile is preferably filtered before it is checked within the scope of the evaluation whether predetermined level limits are undershot or exceeded by the then filtered pressure profile. The filtering serves here to smooth the pressure profile and to avoid distortion of the fault detection by possible atypical values in the pressure profile.

The comparison of the pressure profile with the predetermined level limits within the scope of the evaluation serves to ensure that a maximum predetermined pressure and a minimum predetermined pressure are not undershot or exceeded, or at any rate not continuously undershot or exceeded.

Alternatively or additionally, a fault state is determined and is identified as a noise fault, if noise of the recorded pressure profile exceeds a predetermined threshold value. For this purpose, within the scope of the evaluation, a noise band analysis of the recorded pressure signal is preferably carried out, in order to record quantitatively the noise which is superimposed on the signal. In this context, a fault state is determined if the noise becomes too large in the sense that it exceeds the predetermined threshold value. The unfiltered pressure profile is preferably used as the basis for the noise band analysis. Within the scope of the noise band analysis it is, in particular, possible for a frequency-dependent or integral intensity of the noise to be obtained. It is possible here to compare the noise intensity with at least one frequency-dependent threshold value, with various, frequency-dependent threshold values, or with a global, integral threshold value.

It is possible that within the scope of the method a defect of the injector is identified if one of the previously mentioned fault states is determined once. However, it is preferred that in the scope of an alternative embodiment of the method the various fault states are initially merely registered, wherein a defect is not determined until these fault states occur repeatedly. It is in fact very easily possible that such a fault state occurs owing to a short-term fluctuation in the operating behavior of the injection system, without a defect actually being present because of this. It is therefore appropriate to avoid unnecessary measures for eliminating a defect, for example an unnecessary exchange of injector, in that a measure which is suitable for eliminating a defect is not taken immediately after every registration of a fault state.

In this context, a method is preferred which is defined by the fact that a defect of the fuel injection device is identified if a fault state counter exceeds a predetermined maximum value, wherein the fault state counter is incremented if a fault state is determined. In one embodiment of the method, each fault state is preferably assigned a separate fault state counter, wherein each fault state counter is in turn assigned a separate, predetermined maximum value. For example, a counter for an absence of injection is incremented if an absence of injection is identified as a fault state. The same also applies correspondingly to the other fault states.

In this context, each injector is preferably assigned for each fault state a counter in each case, wherein the maximum values which are predetermined for the individual fault states are preferably the same for all the injectors. However, it is also possible to determine maximum values which differ not only in respect of the individual fault states but also in respect of the individual injectors.

The predetermined maximum values are preferably selected in such a way that it is possible to assume that there is a defect of the fuel injection device, in particular a defect of the injector or of a component which is assigned to it, for example of the quantity-limiting valve which is assigned to the injector, if the fault state which is assigned to the counter has occurred with a frequency whose value exceeds the predetermined maximum value. In order to determine the maximum value it is possible, for example, to define a probability with which a corresponding frequency of occurrence is no longer random.

In one preferred embodiment, a second validity counter is provided for the fault state of an invalid injection, which validity counter is incremented if the obtained injection time lies outside the instantaneously applicable validity range. The counter is preferably decremented if the obtained injection time lies inside this validity range. In this context, as already described above, the instantaneously applicable validity range itself is varied within the scope of the method between the learnt and the unlearnt validity range, depending on the learning progress of the actuation of the injector.

As already described, short-term drifting is intercepted here in that it is detected by means of the first validity counter, in response to which the learning progress counter can be decremented. This decreasing of the learning progress avoids the second validity counter already exceeding the maximum value assigned to it in the event of short-term drifting of an injector, with the result that a defect of the injector would be detected too early. As a result of the increasing of the instantaneously applicable validity range, in fact a relatively large number of detected injection times occur again within the instantaneously applicable validity range even in the case of short-term drifting, with the result that the second validity counter is not incremented. If the obtained injection times are distributed more tightly about the setpoint injection time again, the learning progress is also incremented again and the instantaneously applicable validity range is reduced. The method in turn gains in sensitivity in respect of detection of faults.

Within the scope of the method, the fault state counters which are assigned to the individual fault states are preferably incremented if a fault state is determined and identified. The individual fault state counters are preferably decremented if a corresponding fault state is not determined and identified within the scope of an injection event. This permits the counters to be reset if no fault state occurs over a relatively long period of time. In this case, in fact the probability that the fault state which has occurred once or at least rarely is a random fluctuation is high. However, in the case of decrementing negative values are preferably avoided. A fault state counter which is at the value zero, is therefore preferably not decremented further if a fault state which is assigned to the counter does not occur.

Accordingly, a defect is preferably identified only when a corresponding fault state occurs with a certain frequency which is predefined by the predetermined maximum value for the fault state counter.

Alternatively or additionally, a method is preferred in which a defect of the fuel injection device, here specifically the injector, is identified if a correction value which is obtained for the actuation of the injector exceeds a predetermined learning limit. As already indicated, the control unit obtains injector-specific correction values for actuating the injectors in order to move the values which are actually implemented by the injectors, such as, in particular, the start of injection, the injection duration and/or the end of injection, as close as possible to the setpoint values which are stored in operating-point-dependent characteristic diagrams. For this purpose, correction values which are used for actuation are stored in correction characteristic diagrams, in particular for a start of energization and a duration of energization, in an operating-point-dependent and injector-specific fashion. If an injector closes, this can cause ever greater correction in the actuation to become necessary, with the result that the corresponding correction values in the characteristic diagrams assigned to the injector increase. Accordingly, learning limits above which wear and/or a defect of the injector occur are preferably defined for the correction values.

In this context, two learning limits are preferably predefined for each correction value, specifically a first, hard learning limit and a second, soft learning limit. When the second learning limit is exceeded, a warning is preferably output, which is, in particular, intended to warn an operator of the internal combustion engine that wear or a defect of an injector is imminent. If the first, hard learning limit is exceeded, the operation of the internal combustion engine is preferably stopped because the safe and/or damage-free operation thereof is no longer ensured.

The first learning limit is preferably stored as a characteristic diagram as a function of a fuel setpoint quantity to be injected, in particular a setpoint volume to be injected, and a start of injection pressure, in particular rail pressure. The second learning limit is preferably stored as a percentage of the value which is stored for the first learning limit. In this respect, the first learning limit is preferably stored in a three-dimensional characteristic diagram as a function of the setpoint quantity and the start of injection pressure, in particular the rail pressure, wherein the second learning limit is stored as a unidimensional value, specifically as a percentage.

In one preferred embodiment of the method, in each case a first and a second learning limit are stored for the correction values of the start of energization of the injectors and for the correction values of the duration of energization of the injectors. If one of these correction values exceeds the predetermined learning limits, a defect or wear of the injector in question can be assumed.

A method is also preferred which is defined by the fact that a pressure sensor is used to record the pressure profile, at least one operating value being recorded by said pressure sensor. This may involve, for example, a sensor current or a sensor voltage. A fault in the pressure sensor is preferably identified if the at least one operating value exceeds or undershoots a predetermined threshold value. Alternatively or additionally, a fault is identified in the pressure sensor if the at least one operating value is outside a predetermined validity interval. Alternatively or additionally it is possible to identify a fault in the pressure sensor if predetermined level limits are exceeded or undershot by the sensor signal. As another alternative or additional possibility, a noise band analysis can be applied to the sensor signal in order to identify a fault in the pressure signal if the obtained intensity of noise exceeds, in a frequency-dependent or integrated fashion, a predetermined threshold value.

A strain gauge or a strain gauge sensor is preferably used as the pressure sensor and is arranged on the individual accumulator or the injector in such a way that it can record the pressure in the individual accumulator.

By recording the at least one operating value of the pressure sensor it is, in particular, also possible to determine whether there is a cable break, a defective sensor cable or a detached sensor cable.

If a fault of the pressure sensor is detected, it is no longer possible to actuate the injector in question on the basis of the measured values which are determined specifically for it. In this case, it is therefore preferred within the scope of the method to actuate and/or correct the injector in question with the mean value of all the other functionally capable injectors. A predetermined maximum value is preferably predefined which indicates how many pressure sensors of the internal combustion engine can be defective before such a mean value correction is no longer possible. If the number of pressure sensors which are detected as being defective exceeds this predetermined maximum value, the actuation for all the injectors which is based on the individual accumulator pressure profile is powered down and adjusted to actuation on the basis of global assumptions about the aging of the injectors. Such measures are known to a person skilled in the art, and more details will therefore not be given on them here.

A method is also preferred which is defined by the fact that it is applied to all the injectors of the internal combustion engine. Therefore, preferably not only individual injectors of the internal combustion engine are monitored for fault states and/or defects using the method but rather all the injectors which the internal combustion engine or the fuel injection device of the internal combustion engine has are monitored. In the event of a fault state the faulty injector is preferably identified, which is readily possible by means of the assignment of the pressure profile, on the basis of which the fault state was determined, to the injector in question.

A method is also preferred which is defined by the fact that it is carried out continuously during the operation of the internal combustion engine. In this context, all the injectors of the internal combustion engine are particularly preferably monitored continuously for fault states and/or defects during the operation.

In one alternative embodiment of the method there is provision that the method is carried out at predetermined time intervals. In this case, the injectors of the internal combustion engine are not monitored continuously but instead it is checked only at certain times or at predetermined time intervals whether there are fault states and/or defects in the region of the fuel injection device. This can be sufficient, under certain circumstances, for safe and damage-free operation of the internal combustion engine, wherein computing time and computing power can be saved if the method is not carried out continuously.

The object is also achieved by providing an internal combustion engine that has a fuel injection device which comprises at least one injector. The at least one injector has an individual accumulator. The internal combustion engine is defined by a pressure sensor which is embodied and arranged in such a way that the pressure in the individual accumulator can be recorded by means of the pressure sensor. In addition, a control unit is provided which is configured to carry out a method according to one of the embodiments described above. In this context, the advantages which have already been explained above in relation to the method are implemented.

The fuel injection device preferably has a common high-pressure accumulator for all the injectors, specifically what is referred to as a common rail. Accordingly, the fuel injection device is preferably embodied as a common rail injection device. The individual accumulators which are additionally assigned to the injectors bring about decoupling of the individual accumulator pressure from the rail pressure, with the result that fault states which are assigned to the injectors can be more safely detected by means of the recording of the individual accumulator pressure profile because the pressure profile in a single individual accumulator is influenced at most to a small degree by pressure profiles in other individual accumulators. In addition, pressure fluctuations in the individual accumulators are propagated into the common high-pressure accumulator only to a small extent, with the result that said common high-pressure accumulator has essentially a high pressure, specifically the rail pressure, which is constant over time.

The control unit is preferably embodied as an engine control unit for the internal combustion engine. Alternatively it is possible for the internal combustion engine to have, on the one hand, an engine control unit for performing control, and, on the other hand, a separate control unit for carrying out the method. In this case, the control unit and the engine control unit are, however, preferably connected to one another via at least one interface, with the result that said units can exchange data.

The pressure sensor is preferably embodied as a strain gauge sensor or as a strain gauge and is particularly preferably arranged directly in the region of the individual accumulator.

In one preferred exemplary embodiment of the internal combustion engine, the control unit is operatively connected to the pressure sensor in order to be able to receive the pressure data recorded by the latter and/or actuate the pressure sensor. It is possible for an operative connection to be provided by means of at least one cable and/or a cableless operative connection.

The control unit preferably has a recording means for the time-resolved recording of a pressure profile which is measured by means of the pressure sensor. Furthermore, the control unit comprises an evaluation means for evaluating the recorded pressure profile.

The evaluation means preferably comprises, in particular, means for determining at least one injection time, in particular a start of injection and an end of injection, wherein the means are preferably designed to carry out a method for obtaining a start of injection and/or an end of injection, as described in German laid-open patent application DE 10 2009 056 381 A1. Furthermore, the evaluation means preferably comprises means for determining a pressure drop in the pressure profile, means for determining a characteristic excessive increase in the pressure profile, means for determining a continuous pressure drop, filter means for filtering the recorded pressure profile, means for determining whether the recorded pressure profile undershoots or exceeds predetermined level limits, and/or means for carrying out a noise band analysis of the recorded pressure profile.

In one preferred exemplary embodiment, the control unit has a determining means which is designed to determine, on the basis of the recorded and evaluated pressure profile, whether there is a fault state of the injection device in the region of the injector. Furthermore, the control unit comprises an identification means with which the fault state can be identified on the basis of the recorded and evaluated pressure profile.

The determining means and the identification means preferably comprise means for determining a fault state and identifying it as an absence of injection, for determining a fault state and identifying it as an incorrect injection, for determining a fault state and identifying it as a quantity-limiting valve fault, for determining a fault state and identifying it as continuous injection, for determining a fault state and identifying it as invalid injection, for determining a fault state and identifying it as a level fault, and/or for determining a fault state and identifying it as a noise fault.

The control unit preferably also comprises injector identification means for individually assigning a determined and identified fault state to an injector.

Furthermore, the control unit preferably comprises means for identifying a defect of the fuel injection device if a fault state counter exceeds a predetermined maximum value or if a correction value which is obtained for actuating the injector exceeds a predetermined learning limit.

It is possible for the method to be stored in a hardware-based fashion in the control unit. Alternatively, it is possible for a computer program product to be loaded into the control unit, which computer program product comprises instructions on the basis of which a method according to one of the embodiments described above is carried out when the computer program product runs on the control unit.

In this respect, a computer program product which comprises instructions on the basis of which a method according to one of the embodiments described above is carried out when the computer program product is run on a control unit of an internal combustion engine is also preferred. Furthermore, a data carrier on which such a computer program product is stored is preferred. An exemplary embodiment of such a data carrier is a control unit in which a corresponding computer program product is stored, or into which a corresponding computer program product is loaded.

Finally, an internal combustion engine is preferred which is defined by the fact that the fuel injection device has a multiplicity of injectors as well as a common high-pressure accumulator for supplying the multiplicity of injectors with fuel. As already stated, such a fuel injection means is embodied as a common rail injection device. The method can particularly advantageously be applied to an internal combustion engine having a multiplicity of injectors because fault states and/or defects can be determined in an injector-specific fashion and assigned to the faulty injector.

The internal combustion engine is preferably embodied as a reciprocating piston engine. In one preferred exemplary embodiment, the internal combustion engine serves to drive, in particular, heavy land vehicles or watercraft, for example mine vehicles, trains, wherein the internal combustion engine is used in a locomotive or a power unit, or to drive ships. A use of the internal combustion engine for driving a defense vehicle, for example a tank, is also possible. An exemplary embodiment of the internal combustion engine is preferably also fixed, for example for the stationary supply of energy in emergency power provision mode, duty operation mode or peak load mode, wherein the internal combustion engine preferably drives a generator in this case. A fixed application of the internal combustion engine for driving auxiliary assemblies, for example fire extinguishing pumps on drilling rigs, is possible. The internal combustion engine is preferably embodied as a diesel engine, as a gasoline engine or as a gas engine for operation with natural gas, biogas, special gas or some other suitable gas. In particular, if the internal combustion engine is embodied as a gas engine, it is suitable to be used for the stationary generation of energy in a combined heat and power unit.

The description of the method, on the one hand, and of the internal combustion engine, on the other, are to be understood as complementary to one another. In particular, features of the internal combustion engine which have been described explicitly or implicitly in relation to the method are preferably individually, or in combination with one another, features of an exemplary embodiment of the internal combustion engine. Conversely, method steps which have been explicitly or implicitly described in relation to the internal combustion engine are preferably individually, or in combination with one another, method steps of an embodiment of the method.

BRIEF DESCRIPTION OF THE DRAWING

The invention will be explained in more detail below with reference to the drawing, in which.

DETAILED DESCRIPTION OF THE INVENTION

Figure 1:
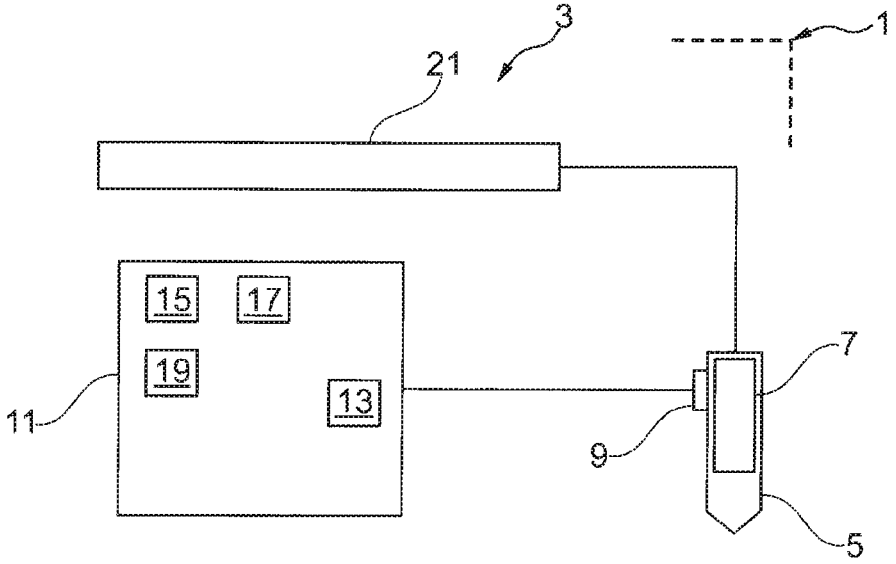
FIG. 1 shows a schematic illustration of an exemplary embodiment of an internal combustion engine.

FIG. 1 shows a schematic illustration of an exemplary embodiment of an internal combustion engine 1. The latter has a fuel injection device 3 which comprises a multiplicity of injectors, of which only one injector 5 is illustrated here, for the sake of simplified illustration. The injector 5 has an individual accumulator 7. Furthermore, a quantity-limiting valve (not illustrated here) which is provided downstream of the individual accumulator 7 is integrated into the injector 5 and prevents an excessively large fuel quantity from being metered into a cylinder, assigned to the injector 5, of the internal combustion engine 1.

A pressure sensor 9 is provided which is arranged on the injector 5 here in such a way that the pressure in the individual accumulator 7 can be recorded by means of the pressure sensor 9.

A control unit 11 is provided which is operatively connected to the pressure sensor 9 in order to record the pressure in the individual accumulator 7. The control unit 11 has a recording means 13 for the time-resolved recording of a pressure profile which is measured by means of the pressure sensor 9. Furthermore, the control unit 11 has an evaluation means 15 for evaluating the recorded pressure profile, wherein said control unit 11 also has a determining means 17 which is designed to determine, on the basis of the recorded and evaluated pressure profile, whether there is a fault state of the injection device 3 in the region of the injector 5. The control unit 11 also comprises an identification means 19 with which the fault state can be identified on the basis of the recorded and evaluated pressure profile.

In the illustrated exemplary embodiment, the fuel injection device 3 comprises a common high-pressure accumulator 21, which is also referred to as a common rail and which is fluidically connected to the injectors 5, and these are therefore supplied with fuel from the high-pressure accumulator 21.

Figure 2:
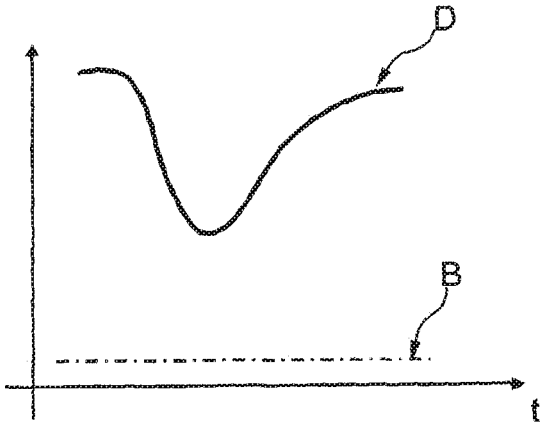
FIG. 2 shows a schematic illustration of a first fault state.

FIG. 2 shows a schematic illustration of a first fault state which can be determined and identified within the scope of the method. Here, FIG. 2 shows a diagram in which a pressure profile D which is recorded for an individual accumulator of an injector is plotted against a time axis characterized by t, as a continuous curve. In this context, a real time in physical units of time or as it were an intrinsic time of the internal combustion engine can be plotted on the time axis in units of an instantaneous angle of the crank shaft (° CA). An injection event in which the pressure profile in the individual accumulator exhibits a pressure drop owing to an injection is illustrated. The profile of an energization value B, which can be a current or a voltage which is recorded for the injector, is also illustrated as a dot-dashed line in FIG. 2.

The fault state which is illustrated in FIG. 2 corresponds to an incorrect injection in which the injector is not energized, which is indicated by the constant profile of the energization value B. Nevertheless, a pressure drop takes place in the individual accumulator, which can be read off on the pressure profile D. Such an incorrect injection can occur, for example, owing to a defective pilot valve or as a result of a short circuit to ground.

Figure 3:
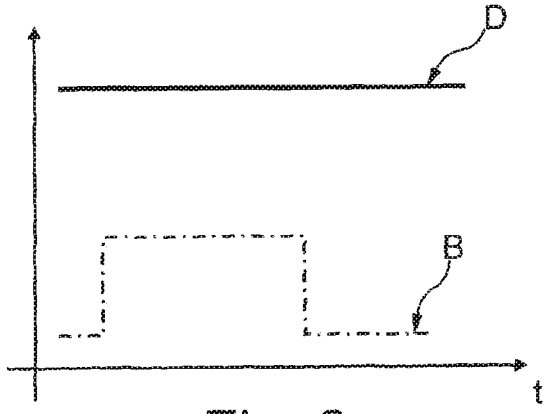
FIG. 3 shows a schematic illustration of a second fault state.

FIG. 3 shows an analogous, schematic illustration of a second fault state which is identified as an absence of injection. It is apparent here that the pressure profile D does not exhibit a pressure drop even though the profile of the energization value B indicates that the injector has been energized. Accordingly, there is a fault in which the injector does not open despite correct actuation.

Figure 4:
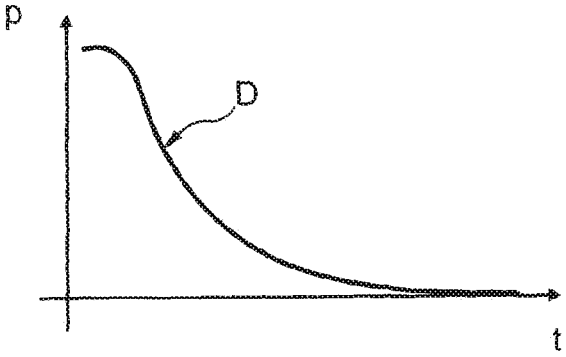
FIG. 4 shows a schematic illustration of a third fault state.

FIG. 4 shows a pressure profile D plotted against a time axis, characterized by t, for a fault state which is identified as continuous injection. In this case, a continuous pressure drop occurs in the individual accumulator, because a fluidic connection is continuously present between the individual accumulator and a cylinder, assigned to the injector, of the internal combustion engine.

Figure 5:
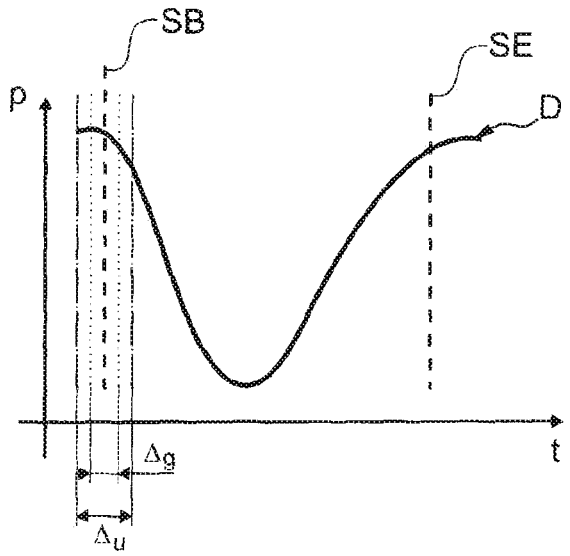
FIG. 5 shows a schematic illustration of a definition of specific validity ranges for injection times.

FIG. 5 shows a schematic illustration of the determination of an invalid injection. In this context, the pressure profile D is also plotted here against the time axis which is denoted by t. Two examples of setpoint injection times, specifically a setpoint start of injection SB and a setpoint end of injection SE, are also plotted as dashed, vertical lines. Corresponding values are preferably stored in characteristic diagrams, particularly preferably as a function of at least the rail pressure, particularly preferably of the rail pressure and a setpoint fuel quantity which is to be injected.

For both setpoint injection times predetermined validity ranges are preferably stored, said validity ranges particularly preferably also being stored as characteristic diagrams, in particular as a function of the rail pressure. This is explained below merely for the setpoint start of injection SB for the sake of simpler illustration. However, the same statements apply equally well also to the setpoint end of injection SE.

There are preferably two validity ranges distributed symmetrically about the setpoint start of injection SB, specifically a first unlearnt validity range $\Delta_u$, which is entered here between two dot-dashed vertical lines, and a second, learnt validity range $\Delta_g$ which is smaller than the unlearnt validity range $\Delta_u$, wherein its limits lie within the limits of the unlearnt validity range $\Delta_u$. Here, the limits of the second learnt validity range $\Delta_g$ are illustrated by dotted vertical lines.

Within the scope of the method, preferably a third, instantaneously applicable validity range is determined whose limits lie between the limits of the unlearnt validity range $\Delta_u$ and the learnt validity range $\Delta_g$, wherein the third validity range is adapted to a learning progress of the injector under consideration.

If, for example, a new injector is used, firstly the entire, unlearnt validity range $\Delta_u$ is applied as a validity range for the determination and identification of an invalid injection. It is apparent that as the learning progress continues, in that the correction values are adapted to the new injector in the corresponding correction characteristic diagrams of the control unit, the measured values which are actually recorded for the start of injection move closer to the setpoint start of injection SB. This learning progress is preferably recorded using a learning progress counter which is incremented if the obtained start of injection is located within the learnt validity range $\Delta_g$. After the expiry of a certain time, for example an operating hour of the internal combustion engine, the learning progress counter is reduced again by a predetermined value, wherein both the time and the predetermined value are preferably parameterizable. Interpolation is carried out between the learnt validity range $\Delta_g$ and the unlearnt validity range $\Delta_u$ using the learning progress counter, with the result that the instantaneously applicable validity range always has at minimum the limits of the learnt validity range $\Delta_g$ and at maximum the limits of the unlearnt validity range $\Delta_u$.

An invalid injection is always determined when the obtained start of injection is outside the instantaneously applicable validity range. The instantaneously applicable validity range can be widened if an instantaneous fluctuation of the injector behavior occurs. For this purpose, a first validity counter is preferably provided which is incremented if the obtained start of injection lies inside the limits of the unlearnt validity range $\Delta_u$ and outside the limits of the learnt validity range $\Delta_g$. If this first validity counter exceeds a predetermined maximum, the learning progress counter is preferably decremented and the instantaneously applicable validity range is increased. The first validity counter is preferably decremented if the obtained start of injection lies inside the limits of the learnt validity range $\Delta_g$. In this context, the first validity counter preferably assumes at minimum the value zero, and therefore does not form any negative counter values.

Figure 6:
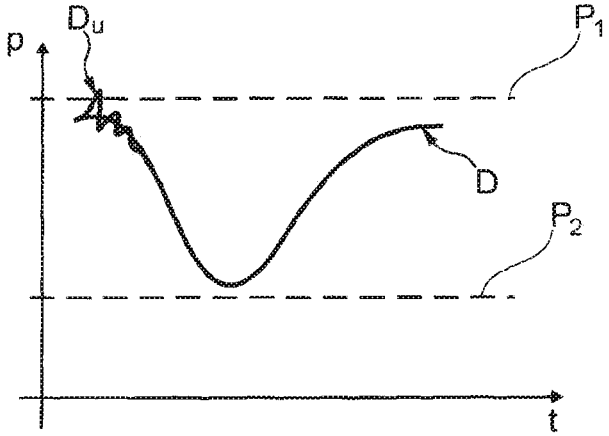
FIG. 6 shows a schematic illustration of the definition of predetermined level limits within the context of an embodiment of the method.

FIG. 6 shows a schematic and diagrammatic illustration relating to the determination and identification of a level fault. In this case, a first, predetermined upper level limit P1 and a second, lower predetermined level limit P2 are defined for the pressure profile, wherein the pressure profile D is intended to extend inside the level limits P1, P2 when the injection device is operating correctly.

In one embodiment of the method it is possible that in this context a filtered and/or averaged pressure profile D is used as the basis for the consideration, which is indicated in FIG. 6 by the unbroken, smooth curve. This curve lies completely inside the level limits P1, P2 here, with the result that no level fault is determined.

In an alternative embodiment of the method it is possible that the consideration is based on the unfiltered pressure profile, which is indicated here partially at the start of the curve profile D by an unfiltered curve $D_u$ which is represented partially. In this context, a tip of the unfiltered curve $D_u$ here projects beyond the upper level limit P1, and therefore in this case a fault state is determined and identified as a level fault.

In one embodiment of the method there is provision that in order to determine and identify a fault state the unfiltered signal of the pressure sensor is compared with a separate filter result thereof, that is to say the signal after filtering, wherein a deviation of the unfiltered signal from the filtered signal is determined in order to ascertain to what extent harmonics, atypical values and/or noise are/is present on the unfiltered signal. It is possible here that a fault state is determined if the deviation of the unfiltered signal from the filtered signal goes beyond a predetermined extent.

Overall it is apparent that the method and the internal combustion engine can be used to carry out a simple and at the same time very reliable and comprehensive on-board diagnosis of the individual injectors or of the fuel injection device in respect of numerous various fault states.

The invention claimed is:

1. A method for injector-specific diagnosis of a fuel injection device of an internal combustion engine, comprising the steps of: time-resolved recording of a pressure profile in an individual accumulator of an injector; evaluating the recorded pressure profile; determining whether there is a fault state of the injection device in a region of the injector based on the recorded and evaluated pressure profile; and identifying the fault state based on the recorded and evaluated pressure profile.

2. The method as claimed in claim 1, including recording the pressure profile in a time-resolved fashion in the individual accumulator synchronized with an energization of the injector, and/or assigning the recorded pressure profile to an injection event.

3. The method as claimed in claim 2, wherein the recording is synchronized simultaneously or overlapping with the energization.

4. The method as claimed in claim 2, further including checking whether the injector is energized.

5. The method as claimed in claim 4, including recording at least one energization value of the energization of the injector and using the recorded energization value to determine a fault state and/or to identify the fault state.

6. The method as claimed in claim 1, including determining a fault state and identifying the fault state as an absence of injection if the injector is energized, wherein a pressure drop in the pressure profile is not determined, or as an incorrect injection if the injector is not energized, wherein a pressure drop in the pressure profile is determined, or as a quantity-limiting valve fault of a quantity-limiting valve which is assigned to the injector, if a characteristic excessive increase is determined in the pressure profile, or as continuous injection, if an enduring pressure drop is detected, or as invalid injection, if an injection time which is obtained from the recorded pressure profile is outside a predetermined validity range, or as a level fault, if the recorded pressure profile undershoots or exceeds level limits which are predetermined after filtering, or as a noise fault, if noise of the recorded pressure profile exceeds a predetermined threshold value.

7. The method as claimed in claim 1, including identifying a defect of the fuel injection device when a fault state counter exceeds a predetermined maximum value, wherein a fault state counter is incremented if a fault state is determined, or a correction value which is obtained for the actuation of the injector exceeds a predetermined learning limit.

8. The method as claimed in claim 1, wherein a pressure sensor is used to record the pressure profile, at least one operating value being recorded by said pressure sensor, wherein a fault in the pressure sensor is identified if the at least one operating value exceeds or undershoots a predetermined threshold value or is outside a predetermined validity interval.

9. The method as claimed in claim 1, including applying the method to all the injectors of the internal combustion engine, wherein in the event of a fault state the faulty injector is identified.

10. The method as claimed in claim 1, including carrying out the method continuously or at predetermined time intervals during operation of the internal combustion engine.

11. An internal combustion engine, comprising: a fuel injection device that includes at least one injector that has an individual accumulator; a pressure sensor embodied and arranged so as to record pressure in the individual accumulator; and a control unit configured to carry out the method of claim 1, wherein the control unit is operatively connected to the pressure sensor, wherein the control unit includes a recorder for time-resolved recording of a pressure profile that is measured by the pressure sensor, wherein the control unit includes an evaluation unit for evaluating the recorded pressure profile, wherein the control unit includes a determining unit designed to determine, based on the recorded and evaluated pressure profile, whether there is a fault state of the injection device in a region of the injector, and wherein the control unit including an identification unit that identifies the fault state based on the recorded and evaluated pressure profile.

12. The internal combustion engine as claimed in claim 11, wherein the fuel injection device has a plurality of injectors as well as a common high-pressure accumulator for supplying the plurality of injectors with fuel.

* * * * *